United States Patent [19]

Fuchs et al.

[11] Patent Number: 4,775,188

[45] Date of Patent: Oct. 4, 1988

[54] FOLDING COMBINATION CHAIR SEAT AND CARRYING CASE

[76] Inventors: John L. Fuchs, 2080 51st Terrace, S.W., Naples, Fla. 33999; Tom Houger, 3501 St. Paul St., #1101, Baltimore, Md. 21218

[21] Appl. No.: 135,082

[22] Filed: Dec. 18, 1987

Related U.S. Application Data

[63] Continuation of Ser. No. 937,892, Dec. 4, 1986, abandoned.

[51] Int. Cl.[4] ..... A47C 4/00; A47C 13/00

[52] U.S. Cl. ..... 297/380; 297/17; 297/129

[58] Field of Search ..... 297/380, 381, 17, 129

[56] References Cited

U.S. PATENT DOCUMENTS

| | | | |
|---|---|---|---|
| 1,756,182 | 4/1930 | Drane | 297/380 |
| 1,831,428 | 11/1931 | Sherman | 297/380 |
| 2,605,817 | 8/1952 | Craig-Wallace | 297/380 |
| 2,759,527 | 8/1956 | Myrick, Jr. | 297/380 |
| 2,797,740 | 7/1957 | Cappello | 297/381 |
| 3,422,938 | 1/1969 | Worcester | 297/17 |
| 3,519,307 | 7/1970 | Gittings | 297/380 |
| 4,079,992 | 3/1978 | Thrift et al. | 297/17 |

*Primary Examiner*—Francis K. Zugel

*Attorney, Agent, or Firm*—Leitner, Greene & Christensen

[57] ABSTRACT

A formed flat blank of corrugated paperboard or the like is peripherally contoured with wing portions or extensions, and impressed with fold lines, such that interfolding and cementing together in predetermined sequence of said wing portions provides comparatively rigid seat and back portions and foldingly interconnectible side gusset portions allowing for conversion between chair seat and carrying case modes of use.

8 Claims, 3 Drawing Sheets

FOLDING COMBINATION CHAIR SEAT AND CARRYING CASE

This is a continuation of application Ser. No. 937,892 filed Dec. 4, 1986, now abandoned.

This invention relates to portable folding chairs, and is directed particularly to an improved folding chair seat that, when in its folded condition, converts to a portable carrying case. As such it is particularly well suited for outdoor recreational use at the beach, at picnics, and sporting events, for example, whereat, in addition to providing seating comfort, allows for the convenient carrying along of small articles of clothing, books, magazines, cameras, field glasses, cosmetics, etc.

Various kinds of folding or convertible chairs and chair seats which, when collapsed or folded together, serve as carrying bags or cases, have heretofore been devised. See, for example, U.S. Pat. Nos. 2,915,154 to Holder, 3,422,931 to Worcester, 3,627,086 to Calgan, 3,817,574 to McNab, 4,079,992 to Thrift and 4,550,950 to Fleishman. The prior art constructions as represented by these patents involves for the most part the use of metal or rigid plastic frameworks. The patent to Fleishman describes a chair fabricated of flexible plywood, bendable to form a chair, but incapable of use as a carrying case.

It is, accordingly, a principal object of this invention to provide a novel and improved folding chair seat and carrying case which obviates the complications of combination chair seat and carrying case devices heretofore known.

It is a more particular object of the invention to provide a combination chair seat of the character described that is fabricated of a formed blank of corrugated paperboard uniquely contoured with wing portions or extensions which, when interfolded and cemented together, provide substantially rigid seat and back portions and foldable interconnecting side gusset portions allowing for conversion between the seat and carrying case modes of use.

Another object of the invention is to provide a folding chair seat of the character described which uses a minimum of inexpensive materials in its manufacture, while at the same time providing a combination folding chair seat and carrying case that is rugged in construction, light in weight, inexpensive to manufacture and durable in use.

Yet another object of the invention is to provide a convertible chair and chair seat which, because of its unusually low cost of manufacture, is well adapted to use as a give-away or low priced item in advertising by placing advertising copy against the outer back panel of the chair where it can be seen both during use as a chair seat and as a carrying case.

Other objects, features and advantages of the invention will be apparent from the following description when read with reference to the accompanying drawings. In the drawings, wherein like reference numerals denote corresponding parts throughout the several views.

Figure 5:
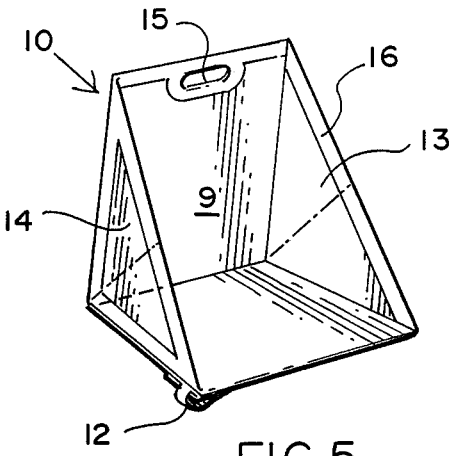
Figure 6:
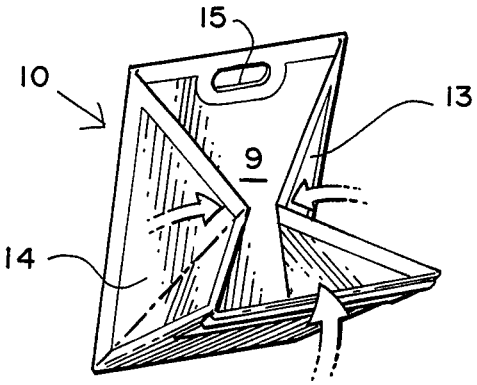
Figure 7:
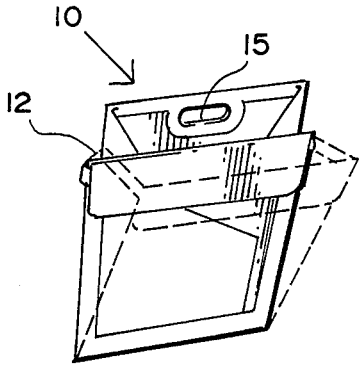
Figure 8:
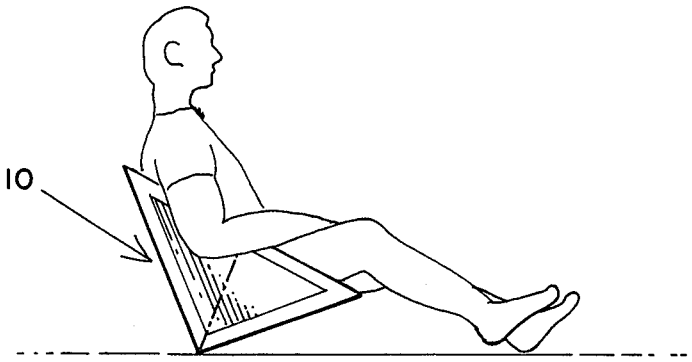

FIGS. 4*a* through 4*e* illustrate the various folds made in succession to complete the fabrication of the chair seat;

FIG. 5 shows the completed chair seat in its upright position of use;

FIG. 6 illustrates how the sides or gussets of the chair seat fold inwardly for compact collapsing when not used as a chair seat;

FIG. 7 illustrates how the folded or collapsed chair seat can be used as a carrying case and;

FIG. 8 is a side elevational view of the chair seat illustrating its use.

Figure 1:
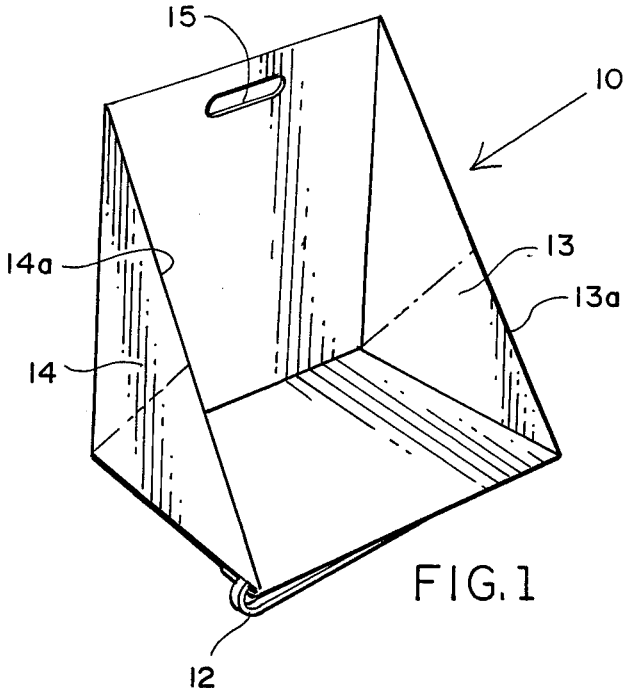
FIG. 1 is an oblique view, as seen from the front, of a folding combination chair seat and carrying case embodying the invention, shown in its unfolded position of use.
Figure 2:
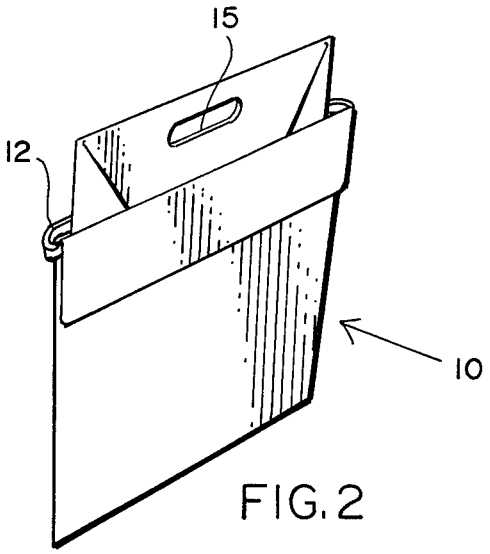
FIG. 2 shows the folding chair seat of FIG. 1 in folded condition for transportation or storage.
Figure 3:
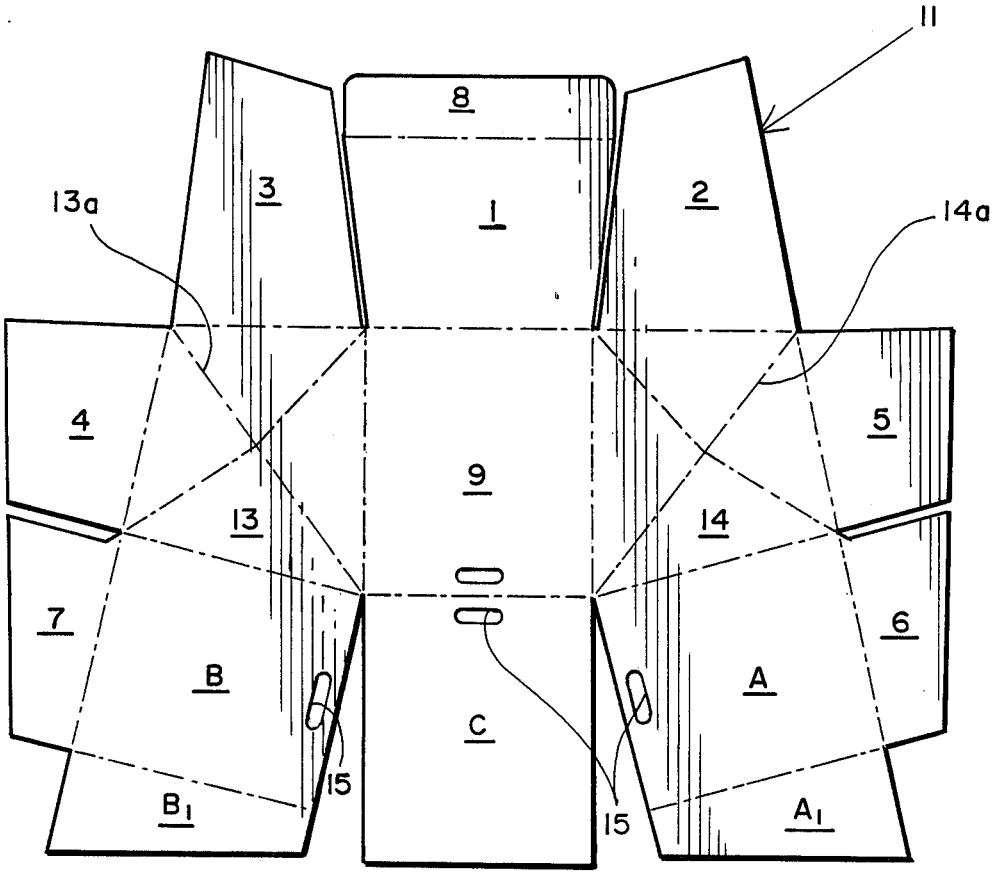
FIG. 3 illustrates the flat blank of sheet material from which the chair seat is fabricated, and further indicates, in broken lines, the folds to be made in fabricating the chair seat.

Referring now in detail to the drawings reference numeral 10 in FIGS. 1,2 and 8 illustrates, generally, a preferred form of folding combination chair seat and carrying case embodying the invention, the same being illustrated in collapsed or folded condition in FIG. 2. The folding chair seat 10 is fabricated, essentially, of flexible paperboard, preferably corrugated paperboard of substantial stiffness, while at the same time having a resiliance allowing for a certain amount of bending, particularly in the seat and back panel areas when subjected to the stresses of usage. To this end, as illustrated in FIG. 3, a flat blank 11 of the corrugated paperboard material illustrated in FIG. 3 is die cut to the peripheral shape illustrated. Because the seat panel of the folding chair seat is subjected to the greatest stresses in use, blank 11 is designed to have a plurality of overlapping seat portions which, when glued together with a suitable flexible adhesive, provide the necessary strength. Thus, as illustrated in FIGS. 4*a* through 4*e*, after folding along the fold lines indicated by the broken lines of the blank,(which fold lines could be mechanically impressed during the stamp-cutting blank formation operation to facilitate folding)the various seat wing portions 2 through 8 will be folded over and secured against the underside of seat panel portion 1 in sequential order to provide the multi-layered or laminated seat panel.

Figure 4A:
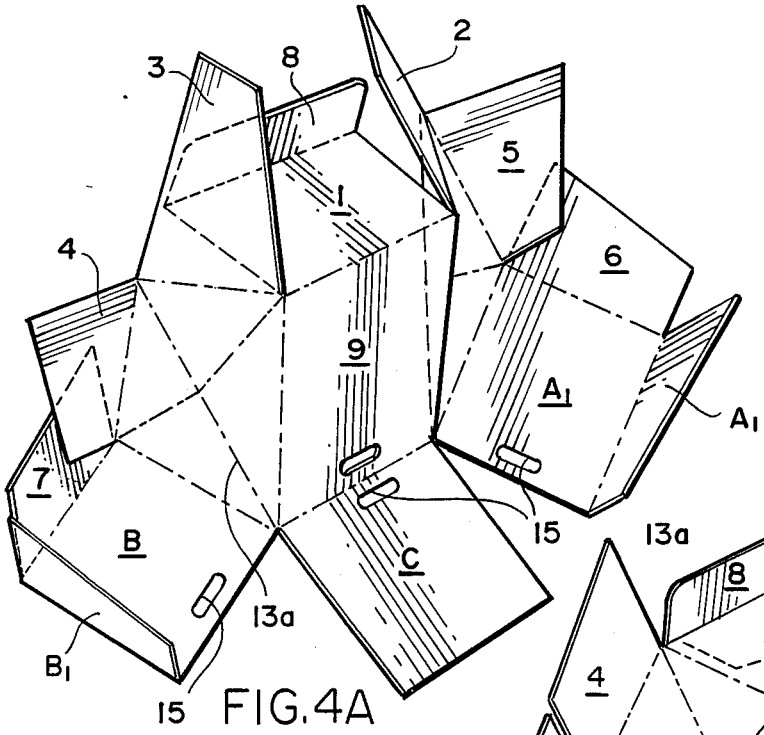
Figure 4B:
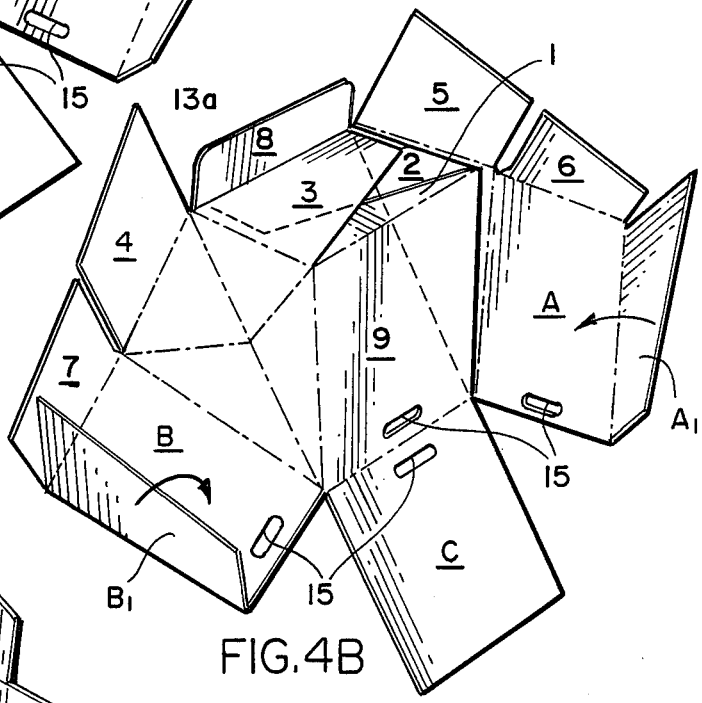
Figure 4C:
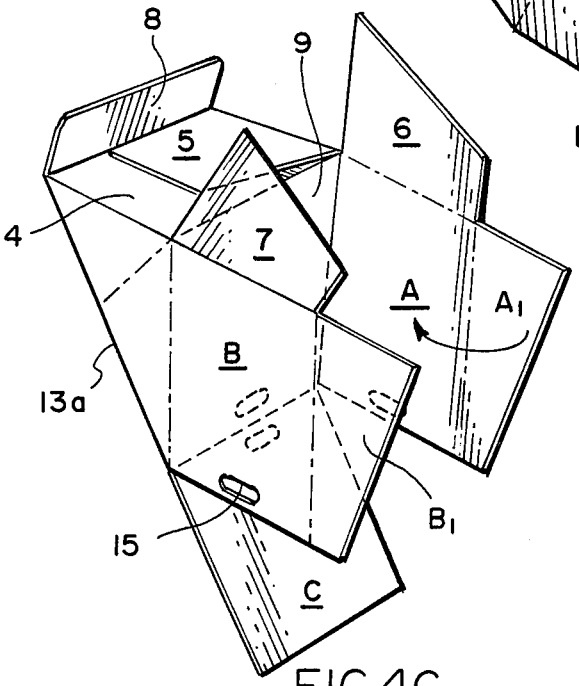

FIGS. 4*a* and 4*b* illustrate how wing portions 2 and 3 are first secured against the underside of seat panel portion 1, and FIG. 4*c* illustrates how wing portions 4 and 5 are subsequently folded down and secured in place.

Figure 4D:
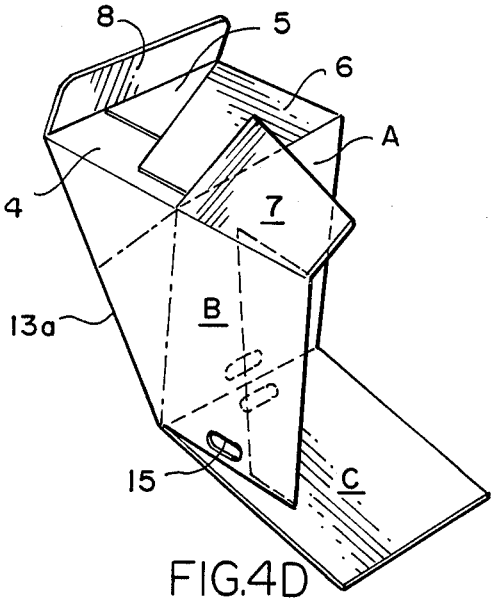
Figure 4C:
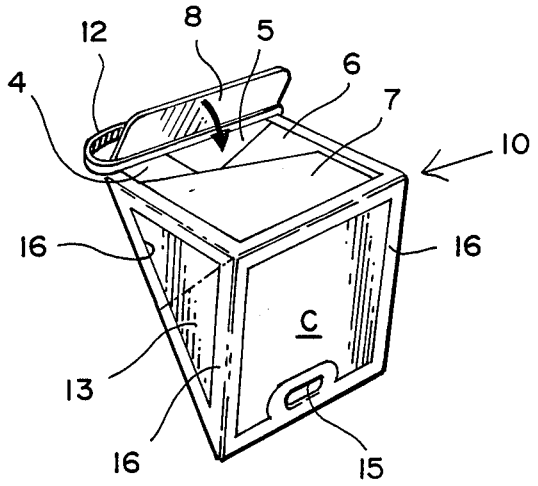

FIGS. 4*d* and 4*e* illustrate how wing portions 6 and 7 are next folded down and secured in place, and as further indicated in FIG. 4*e* and as illustrated in FIGS. 4*a*, 6 and 7, how the seat wing portion 8 is thereafter doubled over to provide additional marginal strength at the front of the chair seat panel while at the same time providing a smoothly rounded front edge.

As best illustrated in FIGS. 4*e*, 5, 6 and 7, an elastic loop or band 12 is secured in place within the fold of seat panel wing portion 8, to serve as means for retaining the seat panel in folded position against the back panel of the chair seat when the chair seat is in collapsed condition as illustrated in FIG. 7. Thus, as illustrated in FIG. 7, since the seat back portion extends beyond the front edge of the seat back portion, the elastic loop can be stretched over and against the back surface of the chair seat back panel to resiliantly constrain the folded seat panel thereagainst. It will be further understood that when the folded-together chair seat is used as a carrying case, the elasticity of the securing loop 12 allows for sufficient opening of the case to permit items of clothing, magazines, books and the like to be inserted for carrying.

In FIGS. 4*c*, 4*d* and 4*e*, it is further illustrated how the chair seat back panel is folded together during the sequential folding together of the chair seat portion as described above. As illustrated in FIG. 4*c*, during the folding in place of seat wing portions 6 and 7, back wing portions A and B will be folded against the secured to central back panel member 9, after wing portions A' and B' having first been folded double against their respective portions A and B.

Thereafter, as illustrated in FIGS. 4*d* and 4*e*, back wing portion C will be folded down and secured against wing portion B to complete the laminated fabrication of the seat back panel. While not as heavily laminated as the chair seat panel, the back panel, also being comprised of several layers, has sufficient added strength to withstand the stresses resulting from leaning back into the back panel during use.

As illustrated in FIG. 3, the blank 11 is also provided with quadrilateral polygonal portions D and E, defined by peripheral fold score lines and cross-fold lines illustrated by broken lines, which, when the blank is foldingly assembled as described above, form the triangular gussets 13, 14, ex tending at each side between the chair seat back and seat panels, as illustrated in FIG. 1. It will be evident that the gussets 13 and 14 are only 2-ply, being subjected to only minimal stresses during usage of the chair seat. As illustrated in FIG. 6, the gussets fold inwardly along the creased or folding lines, 13*a*, 14*a*, as impressed in the blank 11.

As illustrated in FIG. 3, the blank 11 will also be die cut or stamped with elongated slots 15 in the various back panel portions which, upon fabrication of the blank into the folding seat, will register with one another to provide a carrying handle centrally located in the back panel near the upper end thereof.

As illustrated in FIG. 4*e*, Nylon tape or the like, 16, can be used to reinforce the outer edges of the seat panel and back panel, the hinge juncture of the seat end back panels at the back of the seat, and the gusset junctions, for added strength along these zones of folding and to eliminate any tendency of separation of free edges of the folded blank portions. Similarly, the handle slot can be reinforced with an overlay of Nylon tape or the like for strengthening purposes and to present a neat appearance of the handle.

After fabrication of the chair seat as described above, all portions except the elastic loop 12 will be finished by spray painting or otherwise coating with one or more heavy coats of a suitable enamel of any desired color for waterproofing as well as aesthetic appeal.

In addition to its principal use as a chair seat at sporting events, picnics and the like, and use as a carrying case, the invention can also be used as an umbrella in case of sudden rain. It is also particularly well suited to use by children when watching TV, as it allows them to swivel and rock in the seat. Because of its low heat conductivity and waterproof nature, moreover, it can be used as an auxiliary seat in an automobile when driving in a wet bathing suit, for example, to protect from the heat of the car seat, as well as protecting against wet spotting of the car seat.

While there is illustrated and described herein only one form in which the invention can conveniently be embodied in practice, it is to be understood that this embodiment is presented by way of example only and not in a limiting sense. The invention, in brief, comprises all the embodiments and modifications coming within the scope and spirit of the following claims.

We claim:

1. A folding combination chair seat and carrying case formed from a foldable blank of paperboard having a seat panel portion, a back panel portion, a gusset polygonal portion on each side of said back panel portion, and a plurality of seat wing portions and back wing portions, said chair seat comprising when folded, in combination, a multi-layered chair seat panel formed of said seat panel portion and said seat wing portions, a multi-layered chair back panel formed of said back panel portion and said back wing portions hingingly connected at a line of juncture to said chair seat panel, and double layered triangular gusset portions at each side extending between and interconnecting the side edges of said chair seat panel and said chair back panel, said gusset portions being foldable along lines extending from said juncture of said seat panel and said chair back panel at each side thereof to permit inward folding of said gusset portions upon the relative swinging together of said seat panel and said back panel.

2. A folding combination chair seat and carrying case as defined in claim 1 wherein the length of said back panel is greater than the length of said seat panel to project outwardly thereof for use as a handle when said seat and back panels are folded together.

3. A folding combination chair seat and carrying case as defined in claim 2 where said outwardly projecting portion of said back panel is provided with an elongated, horizontally-extending slot for use as a hand grip.

4. A folding combination chair seat and carrying case as defined in claim 2 including resilient means interconnectible between an outer edge portion of said seat panel and the outer end of said back panel to resiliently retain said seat panel in folded position against said back panel while at the same time allowing for pull-apart opening to provide compartment space therebetween when used as a carrying case.

5. A folding combination chair seat and carrying case as defined in claim 1 which is integrally fabricated of a flat sheet of paperboard.

6. A folding combination chair seat and carrying case as defined in claim 1 which is integrally fabricated of a flat sheet of corrugated paperboard.

7. A folding combination chair seat and carrying case as defined in claim 6 wherein said flat sheet is of corrugated paperboard peripherally contoured with wing portions and impressed with fold lines allowing for interfolding and cementing together in predetermined sequence of said wing portions to provide said chair seat and chair back panels.

8. A folding combination chair seat and carrying case as defined in claim 7 wherein said folded-together wing portions laminate said seat and back panels with multiple layers to provide for enhanced rigidity of said seat and back panel portions as compared with the rigidity of said gussets.

* * * * *